US006533278B1

(12) United States Patent
Drastrup

(10) Patent No.: US 6,533,278 B1
(45) Date of Patent: Mar. 18, 2003

(54) GAME APPARATUS

(76) Inventor: Gitte Engel Drastrup, Kratmosevej 32, Vedbaek (DK), DK-2950

( * ) Notice: Subject to any disclaimer, the term of this patent is extended or adjusted under 35 U.S.C. 154(b) by 0 days.

(21) Appl. No.: 09/497,686

(22) Filed: Feb. 4, 2000

(51) Int. Cl.[7] ..... A63F 3/00
(52) U.S. Cl. ..... 273/236; 273/292; 273/242; 273/244.2
(58) Field of Search ..... 273/294, 292, 273/236, 258, 244.2, 242

(56) References Cited

U.S. PATENT DOCUMENTS

| | | | | | |
|---|---|---|---|---|---|
| 2,026,082 | A | | 12/1935 | Darrow | |
| 3,759,521 | A | * | 9/1973 | Breslow et al. | 273/134 B |
| 3,759,522 | A | * | 9/1973 | Hodan, III | 273/135 AA |
| 4,346,897 | A | * | 8/1982 | Sisak | 273/271 |
| 4,736,954 | A | * | 4/1988 | Haney et al. | 273/236 |
| 4,940,235 | A | * | 7/1990 | Martin | 273/236 |
| 4,991,853 | A | * | 2/1991 | Lott | 273/242 |
| 5,013,048 | A | * | 5/1991 | Turner | 273/242 |
| 5,332,229 | A | * | 7/1994 | Fielder et al. | 273/271 |
| 5,816,819 | A | * | 10/1998 | Rockburn | 434/106 |
| 5,897,115 | A | * | 4/1999 | Sherry et al. | 273/242 |
| 6,120,296 | A | * | 9/2000 | Lim | 434/128 |
| 6,254,101 | B1 | * | 7/2001 | Young | 273/460 |
| 6,279,909 | B1 | * | 8/2001 | Alexander, II et al. | 273/249 |

FOREIGN PATENT DOCUMENTS

| | | |
|---|---|---|
| GB | 2 198 361 | 6/1988 |

* cited by examiner

*Primary Examiner*—Benjamin H. Layno
*Assistant Examiner*—Dolores Collins
(74) *Attorney, Agent, or Firm*—Volentine Francos PLLC

(57) ABSTRACT

A game in which all teams participate actively in the game during each turn of the game. No teams are forced to stay idle during a turn. Before a team having a turn answers a question printed on a drawn question card, this team has to bet that the team can answer the question correctly. The other teams may bet on whether the answer to be given will be the correct answer or not. In this way all teams are engaged in the game at all time.

25 Claims, 9 Drawing Sheets

FIG. 10

Is a butterfly an insect?

© Engel 1999

What do parrots claws look like?
• Three claws forward and two backwards
• Two claws forward and two backwards
• Two claws forward and three backwards © Engel 1999

17

Write down all the states that border on Colorado. The player/team that get most states right wins.

© Engel 1999

17

All teams throw the two dices. The first team that gets less than five in one throw wins.

© Engel 1999

Which team can create most words using these letters? You can not make words with two "a"s, if there is only one listed below, but you may use the "a" in each word you create:
A, D, E, E, G, H, I, L, L, P, S © Engel 1999

One player from the team has to make his/her teammembers to say this phrase, without using any of the words from the phrase himself.

"My mother in law drives me crazy".

© Engel 1999

One player from the team has to make his/her team-members say these six words, without using the words himself:
Patience, coffeemachine, golfclub, helpful, pencil, work © Engel 1999

What is the frequency of the pulse at rest for?
A Adults
B Children
C Babies

---

1 130-150
2 80-100
3 60-80

© Engel 1999

Which three of these brands were between the nine most well known brands in 1991 in the US?
Coca-Cola, Kodak
Ford, Pepsi
Nike, Mars © Engel 1999

How many sacraments does the protestant church have? You get an extra braincell, if you mention which ones.

© Engel 1999

17

Write all the words you can, that start with "bus". The player/team that writes most words win.

© Engel 1999

17

All players/teams write as many words as they can that has to do with a school, starting with the letter "k".
The player/team that has written most words win.

© Engel 1999

17

One person from each team draws as many animals as possible. After the clock has run out, the other team-members have to guess which animals their teammember has drawn. The team who guesses most drawings win.

© Engel 1999

In what year did they all win an Oscar?
Best film: Dancing with wolves
Best instructor: Kevin Costner
Best male leading role:
Jeremy Irons
Best female leading role:
Kathy Bates © Engel 1999

10

GAME APPARATUS

The present invention relates to the field of games for amusement and entertainment. More particularly, this invention relates to a new board game in which all participants in the game are simultaneously involved. Nobody has to wait while another player takes a turn.

BACKGROUND OF THE INVENTION

Board games of various types in the prior art have provided entertainment for players. These board games have a great diversity from real estate sales games such as MONOPOLY to war games such as RISK and to games with questions and answers such as TRIVIAL PURSUIT.

In games with questions and answers such as TRIVIAL PURSUIT, it is often seen that players not having a turn are not committed to the game. They stay idle and may be even bored while awaiting their turn.

Further in a game like TRIVIAL PURSUIT players are required to have an extensive knowledge of several subjects in order to be able to answer a reasonable proportion of the questions asked during the game and therefore players without such knowledge do not find the game entertaining.

SUMMARY OF THE INVENTION

It is an object of the present invention to provide a board game apparatus to be used in an entertaining game with questions and answers and wherein all players are involved in the game when any player or team of players has a turn.

It is another object of the invention to provide a board game apparatus with questions of a structure that is adapted to assist a player in answering the question so that even players without the a priori knowledge needed to answer the question may still have a chance to answer the question correctly.

Below, a team of players is termed a "team". A team is constituted by one or more players playing together against one or more other teams.

According to the present invention the above-mentioned and other objects are fulfilled by a method of playing a game comprising:

(a) providing each team with a quantity of play pieces for keeping a score, (b) providing question cards, each of the question cards having a printed question printed thereon, (c) a team selecting one of the question cards, (d) the team having a turn betting a selected number of play pieces that the team having a turn can answer the question correctly, (e) teams not having a turn optionally betting a selected number of play pieces on whether or not the team having a turn can answer the question correctly, whereby all teams participate actively in the game during each turn of the game, (f) the team having a turn answering the question, (g) teams collecting or paying play pieces according to the betting result and starting the next turn, (h) the game ending when one of the teams has won a predetermined number of play pieces, this team being declared the winner.

In a preferred embodiment of the invention, the method also comprises:

(a) providing a game board having a selector for selecting a set of questions from a plurality of sets of questions, (b) providing question cards with a respective question from the set of questions printed thereon and being distinctly marked accordingly, and wherein (c) the team having a turn activates the selector for selection of a specific set of questions.

Provision of a selector and dividing questions into sets of questions gives players an opportunity to utilize knowledge about other players when betting. If for example questions are divided into categories according to topics, such as geography, biology, physics, sport, politics, etc, some teams may prove to have a lot of knowledge within some categories and less within others. During the game, players may notice the capabilities of other teams and utilize this experience when betting.

Further, an apparatus is provided comprising a quantity of play pieces for keeping a score, and question cards, each of the question cards having a printed question printed thereon, and to be used in the above-mentioned game.

In another embodiment of the invention, the apparatus also comprises a game apparatus with a selector for selecting a set of questions from a plurality of sets of questions, and question cards with a respective question from the set of questions printed thereon and being distinctly marked accordingly, and wherein the team having a turn activates the selector for selection of a specific set of questions.

It is the gist of the present game that all teams participate actively in the game during each turn of the game. No teams are forced to stay idle during a turn. Before a team having a turn answers a question printed on a drawn question card, this team has to bet that the team can answer the question correctly. The other teams may bet on whether the answer to be given will be the correct answer or not. In this way all teams are engaged in the game all the time.

BRIEF DESCRIPTION OF THE DRAWINGS

FIG. 10 shows fronts of question cards with different types of questions.

DETAILED DESCRIPTION OF PREFERRED EMBODIMENTS

Figure 1:
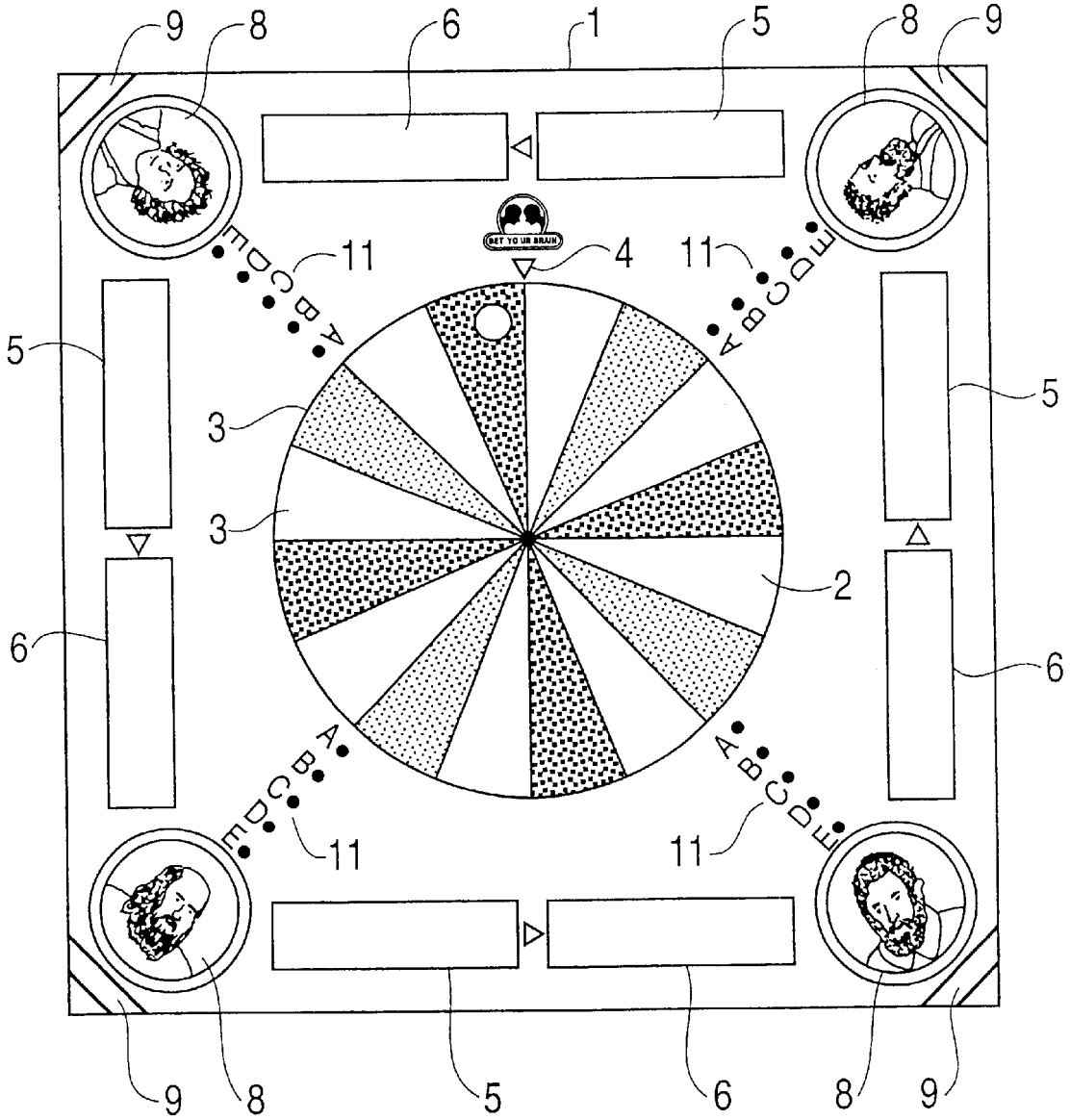
FIG. 1 shows a plan view of a preferred embodiment of a board apparatus according to the present invention.

A game board 1 according to the present invention is shown in FIG. 1. A rotatable turn table 2 operating like a wheel of fortune is positioned at the center of the game board and constitutes the selector for selecting a set of questions. As shown, the turn table is divided into a plurality of equal angular sections 3 of a specific color. Each color corresponds to a specific set of questions. The team having a turn sets the turn table 2 in rotation and when the turn table 2 stops, the color of the section 3 adjacent to the indicator 4 determines the selected set of questions. The number of teams is not fixed. The board shown in FIG. 1 is adapted for a maximum of four teams. It is obvious that the game board 1 could be modified for more players, e.g. by forming the game board 1 as a polygon with more sides than four, e.g. a hexagon.

Figure 7:
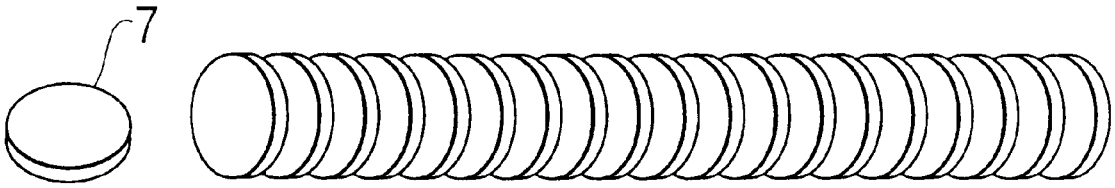
FIG. 7 is a perspective view of a number of play pieces.

The game board 1 contains holders 5, 6 for storage of the play pieces 7 shown in FIG. 7. In this example, the holders 5, 6 are grooves of a depth that is approximately equal to the radius of the play pieces 7 and of a width that is approximately equal to the diameter of the play pieces 7 so that play pieces 7 may be easily positioned in the holders 5, 6.

At the corners of the game board 1, circular spaces 8 are marked for positioning of the number of play pieces that the corresponding team wants to bet on the outcome of the question and answer session.

The exemplary game board 1 of FIG. 1 also has question card holders 9 for holding a set of question cards. Preferably, there is provided a large number of question cards with the game according to the present invention and one of the holders 9 will not be able to hold all cards from a specific set of cards. One of the players select an appropriate pile of cards from one of the set of cards to be inserted in the corresponding holder 9. The holders 9 are recesses in the game board 1 having a width that is slightly greater than the thickness of the pile of question cards 10 so that the pile of question cards 10 may be conveniently inserted and held in the recess while a question card may be easily drawn from the pile and put back into the pile without removal of the pile from the recess.

The game board 1 further contains indicators 11, 12 for indication of how the team having a turn pairs questions and answers printed on one type of question cards 10. For example, questions on this type of question cards 10 may be marked A, B, C, . . . etc and respective answers to the questions may be marked 1, 2, 3, . . . etc. Correspondingly, the game board has holes marked A, B, C, . . . etc, and pins 9 fitting into the holes and having numbered heads are provided. For each of the questions marked A, B, C, . . . etc, the team having a turn inserts a pin with a specific number into the hole marked with the corresponding letter thereby indicating how questions and answers from the question card are paired.

At the start of the game, each playing team is assigned to a specific side of the game board 1. Each of the circular spaces 8 is marked with a unique color corresponding to one of the sets of questions and has an image of a famous person, e.g. Leonardo da Vinci, Marco Polo, Graham Bell, and Ludwig van Beethoven. Each team may select a side by selection of a specific one of the famous persons. Each team receives 20 play pieces 7 and inserts the play pieces 7, which may be referred to or denoted hereinafter as "brain cells", in the play pieces holder 5, 6 to the left. Each of the set of question cards 10 are inserted in a respective question card holder 9. The first and last card in each set of question cards 10 are covered by cards without questions and answers so that teams are unable to read questions and answer of cards that have not yet been selected. Each team also receives numbered pins for indication of pairing of questions and answers.

It is agreed which one of the teams starts the game, e.g. the team with the oldest player starts. The team having a turn puts the turn table 2 into rotation. The turn table 2 is required to make at least one revolution. When it stops, the color located at the indicator 3 determines the selected set of questions. Then the teams bet on the outcome of the question and answer session. The team having a turn has to bet 1, 2 or 3 "brain cells" 7 that the answer is going to be correct. The selected number of "brain cells" 7 is put on the marked space 8 to the right of the "brain cells" holders 5, 6. The other teams may bet 0, 1 or 2 "brain cells" 7 on the outcome of the question and answer session. If the bet is that the answer will be correct, the "brain cells" are positioned horizontally on the marked space 8, and if the bet is that the answer will be wrong, the "brain cells" are positioned vertically on the marked space 8.

Then, the team having the marked space 8 with the color of the selected set of questions draws the next question from the selected set. When the question has been asked a timer, e.g. a sandglass, is started. If the time elapses, the question has not been answered correctly.

In the present example, the game apparatus has four different set of questions and colors, and famous persons that are assigned to each other as specified below:

White is assigned to Leonardo da Vinci and the set of questions within the categories:
Miscellaneous and Word Games, Blue is assigned to Marco Polo and the set of questions within the categories:
Geography and Biology, Yellow is assigned to Graham Bell and the set of questions within the categories:
History and Religion, Green is assigned to Ludwig van Beethoven and the set of questions within the categories:
Entertainment, Sport and Drawing.

The holder 6 to the right is the "store" 6 and the holder 5 to the left is the "bank" 5.

When the team having a turn has answered the question or the time has run out, teams having won their bets move the "brain cells" from the marked space 8 to the "store" 6, and in addition, move the same number of "brain cells" from the "bank" 5 to the "store" 6. Teams having lost their bet move the "brain cells" from the marked space 8 to the "bank" 5. When making a bet, only "brain cells" stored in the "store" 6 may be used unless the "store" 6 is empty. Then "brain cells" may be borrowed from the "bank" 5. When a team wins with borrowed "brain cells", the borrowed "brain cells" are moved to the "store" 6. No additional "brain cells" are moved from the "bank" 5 to the "store" 6. When a team loses with borrowed "brain cells", the borrowed "brain cells" are moved back to the "bank" 5. Borrowed "brain cells" do not have to be paid back at any later stage of the game.

When the teams have moved their "brain cells" according to the betting result, the next turn is started by the next team having a turn putting the turn table into rotation. After each turn, the turn is shifted in a clockwise direction unless the question cards specify otherwise.

The team that has been first to move all of its "brain cells" from the "bank" 5 to the "store" 6 is the winner of the game.

In other embodiments of the game board apparatus, the turn table may be substituted by another selector.

Figure 2:
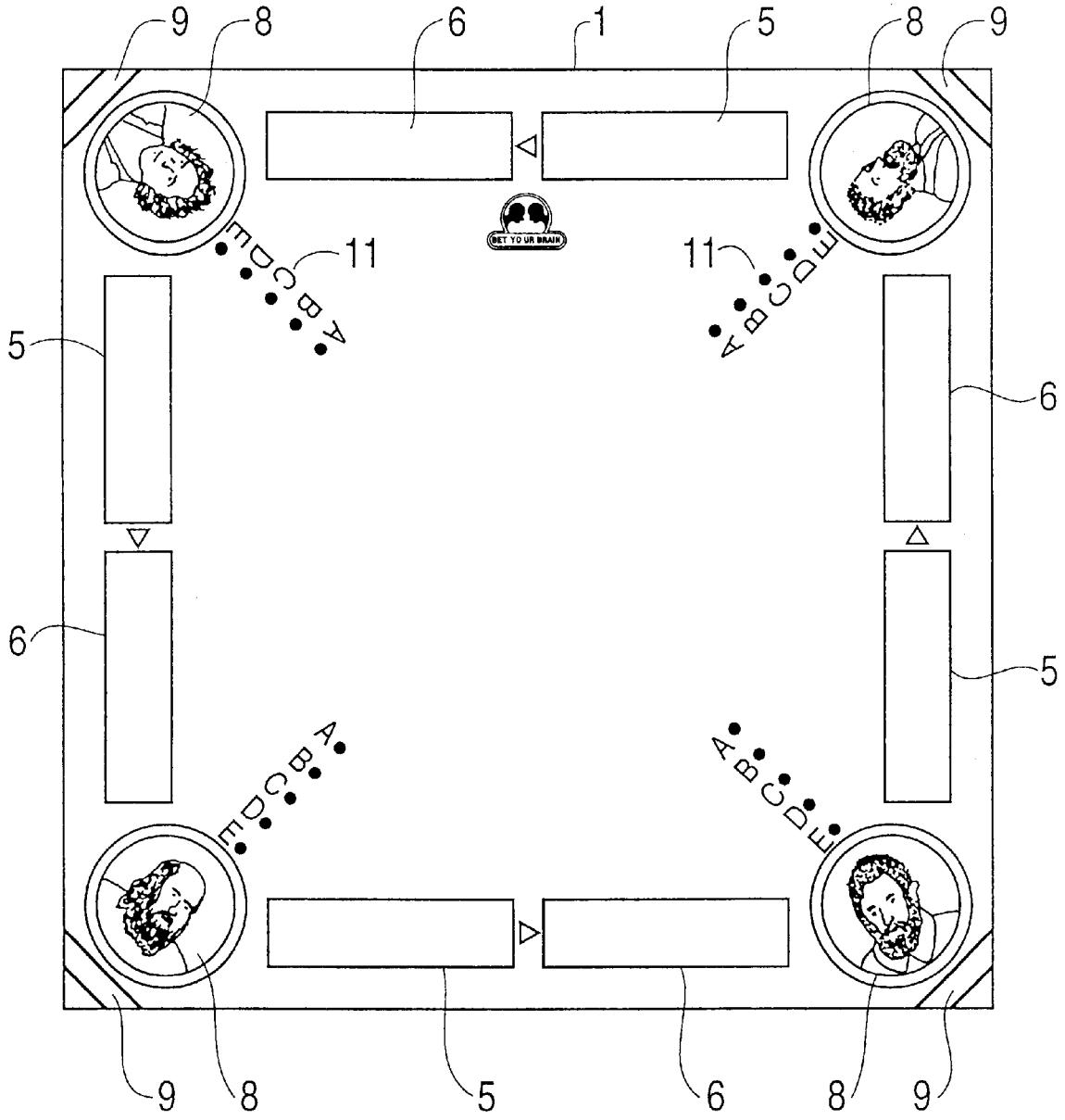
FIG. 2 shows a plan view of a second embodiment of a board apparatus according to the present invention.

In FIG. 2, a game board 1 of a second embodiment of the invention is shown that does not have a selector and that provides a single set of question cards.

Figure 3:
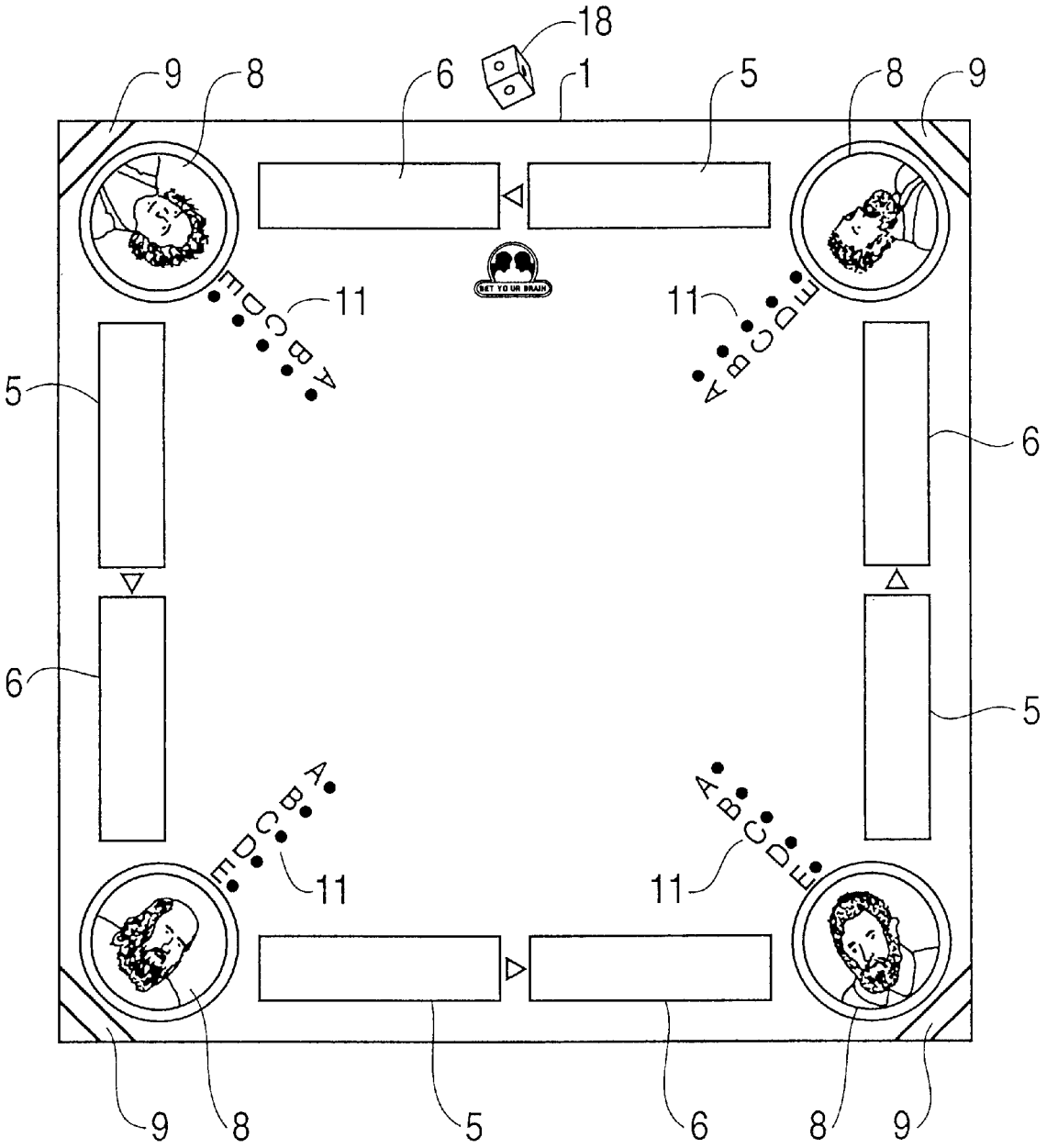
FIG. 3 shows a plan view of a third embodiment of a board apparatus according to the present invention.
Figure 8:
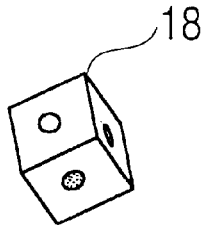
FIG. 8 is a perspective view of a dice with colors.
Figure 9:
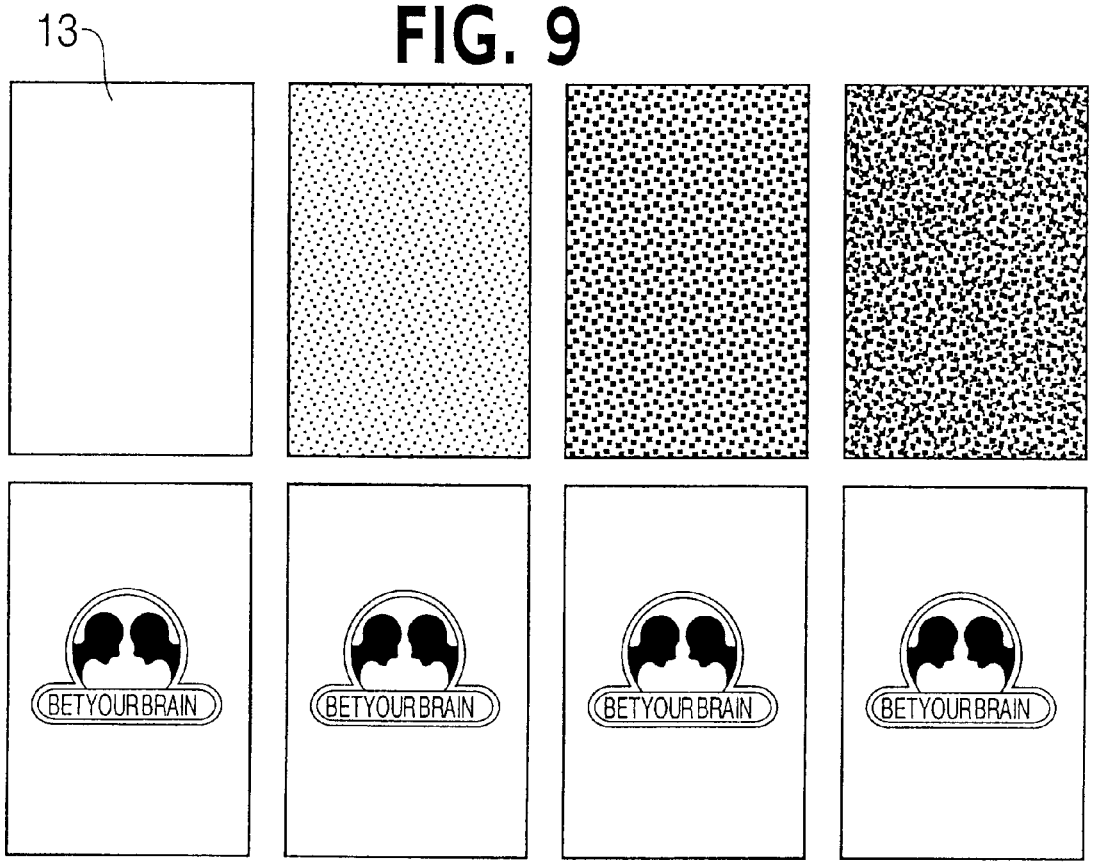
FIG. 9 shows a set of colored selector cards.

In FIG. 3, a game board 1 of a third embodiment of the invention is shown, wherein the selector comprises a dice 18 as shown in FIG. 8 with different colors on different sides, each color corresponding to a specific set of questions. A set of questions is selected by a throw of the colored dice, the color shown by the dice determining the selected set of questions.

Figure 4:
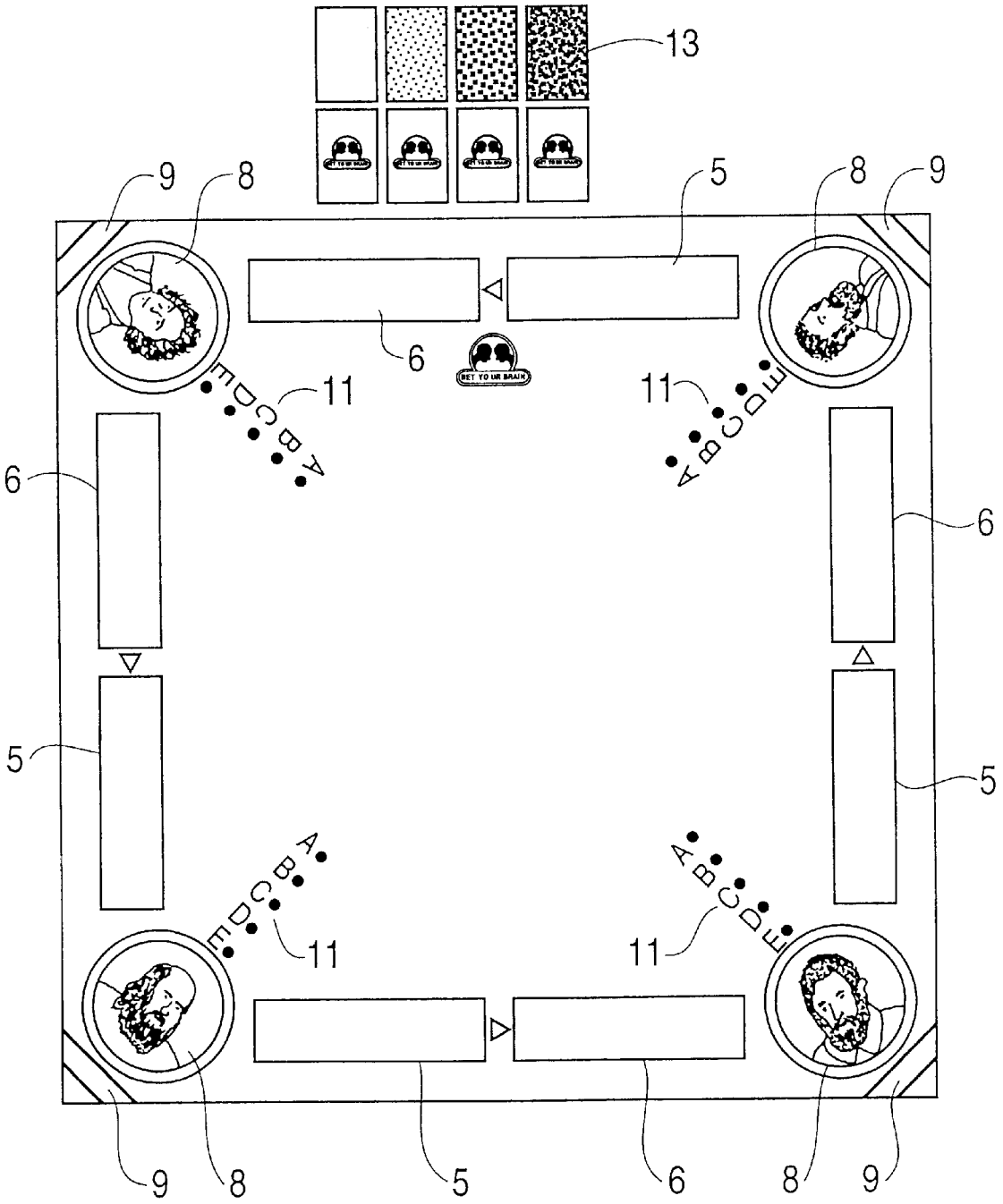
FIG. 4 shows a plan view of a fourth embodiment of a board apparatus according to the present invention.

In FIG. 4, a game board 1 of a fourth embodiment of the invention is shown, wherein the selector comprises a set of colored selector cards 13, each color corresponding to a specific set of questions. A set of questions is selected by one of the players drawing one of the selector cards, the mark of the drawn selector card determining the selected set of questions.

Figure 5:
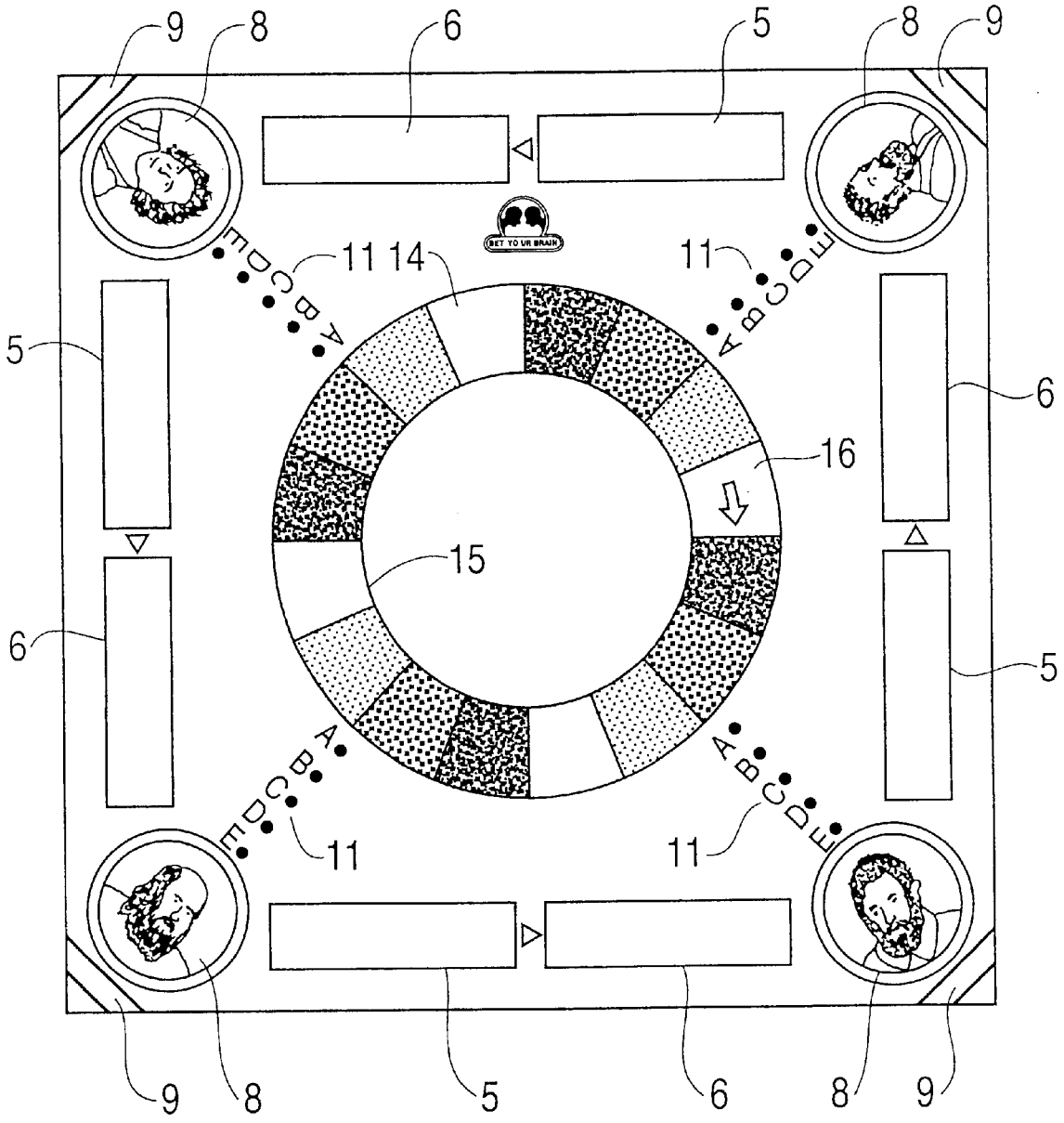
FIG. 5 shows a plan view of a fifth embodiment of a board apparatus according to the present invention.
Figure 6:
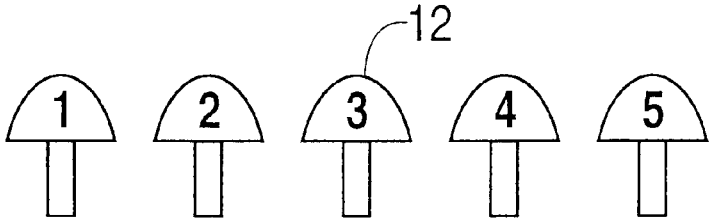
FIG. 6 shows a set of indicators.

In FIG. 5, a game board 1 of a fifth embodiment of the invention is shown, wherein the selector comprises multiple playing spaces 14 forming a contiguous path 15 around the game board 1 from a start space 16. A throw of at least one dice determines the moves of a team moving piece. Each of the playing spaces 14 is marked with a distinct color to indicate a specific set of questions. The mark of the playing space 14 that the moving piece is landed on determines the selected set of questions.

Figure 11:
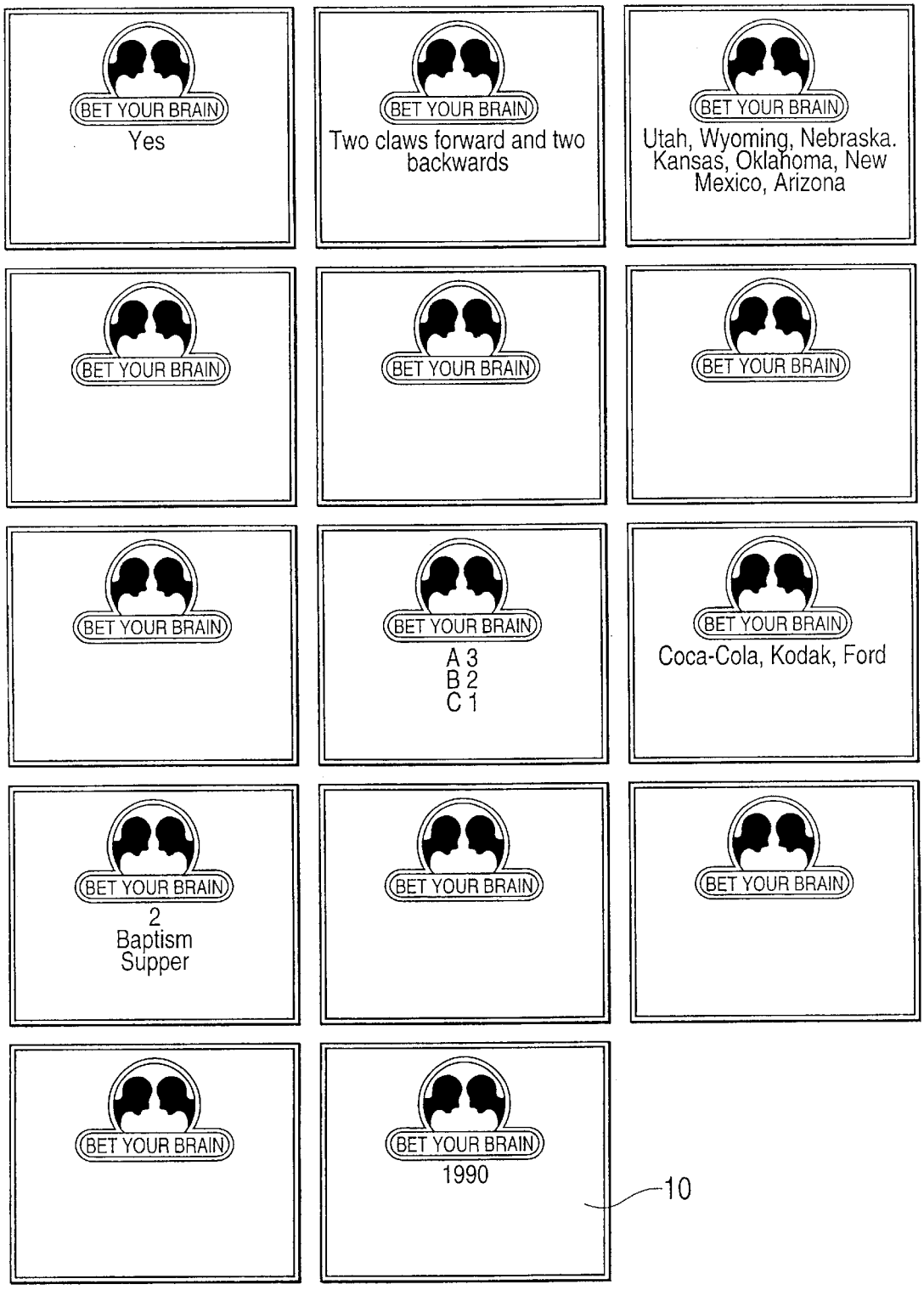
FIG. 11 shows backs of the question cards shown in FIG. 10 with corresponding answers.

Fronts and backs of question cards according to the present invention are illustrated in FIGS. 10 and 11, respectively. Questions and tasks are printed on the front of the cards and, when appropriate, answers are printed on the back of the cards. In FIGS. 10 and 11, a front and a back of the same card are shown at the same relative position in the illustrated group of cards.

A first type of question cards 10, e.g. the card in column 1, row 1 in FIG. 10, has a type of question with two possible answers, e.g. "yes" or "no". The correct answer is printed on the back of the card.

A second type of question cards 10, e.g. the card in column 2, row 1 of FIG. 10, has a set of possible answers to the question printed thereon and the team having a turn answers the question by selecting one of the printed answers as the team's answer.

Question cards 10 of this type assist a playing team in answering the question so that even teams without the a priori knowledge needed to answer the question may still have a chance to answer the question correctly.

As shown in FIG. 10, cards 10 are provided with a specific mark 17 indicating that all teams are going to compete against each other solving a task specified on the card, e.g. column 3, row 1 and 4; column 1, row 2, 5; column 2, row 2 and 4. The teams bet on whether or not the team having a turn wins the competition. The team winning the competition takes the next turn. If the competition is a draw, the playing sequence remains unchanged. If the team having a turn has a draw with another team, the teams having a draw move their stakes to the "store" 6.

For example, a third type of question cards 10, e.g. the card in column 3, row 1 of FIG. 10, has a question to be answered by all the teams. The question has a plurality of correct answers and the team that write down most correct answers wins the competition.

A fourth type of question cards 10, e.g. the card in column 1, row 2 of FIG. 10, specifies a game of dice. All teams have to throw a pair of dices. The first team throwing less than five wins the competition.

A fifth type of question cards 10, e.g. the card in column 2, row 2 of FIG. 10, has a task to be performed by all teams. A number of letters are listed on the card and teams are asked to create words containing the listed letters. The team listing most correct words wins the competition.

A sixth type of question cards 10, e.g. the card in column 3, row 2 of FIG. 10, contains a statement to be guessed by the team. Within a predetermined time, one of the team members has to describe the statement to the other team members without using any of the words from the original statement, and the other team members have to guess the words of the original sentence.

A seventh type of question cards 10, e.g. the card in column 1, row 3 of FIG. 10, has a list of words to be guessed by the team having a turn. A team member describes the word to another team member without using the word itself.

An eighth type of question cards 10, e.g. the card in column 2, row 3 of FIG. 10, has a number of questions and the same number of answers printed thereon, and the task of the team having a turn is to pair the questions and answers correctly using the indicators 11, 12.

A ninth type of question cards 10, e.g. the card in column 3, row 3 of FIG. 10, has a question and a number of possible answers to the question printed on the card. The correct answer to the.question comprises a plurality of the possible printed answers.

A tenth type of question cards 10, e.g. the card in column 1, row 4 of FIG. 10, has an extra question printed thereon. If the team having a turn answers the extra question correctly, this team is allowed to move an extra "brain cell" from the "bank" 5 to the "store" 6.

An eleventh type of question cards 10, e.g. the card in column 2, row 4 of FIG. 10, asks all teams to write down words with a specific characteristic. In the example, teams are asked to write down words starting with "bus".

A twelfth type of question cards 10, e.g. the card in column 3, row 4 of FIG. 10, asks all teams to write down words with a specific characteristic and used in a specific context. In the example, teams are asked to write down words starting with the letter "k" and being related to a "school".

A thirteenth type of question cards 10, e.g. the card in column 1, row 5 of FIG. 10, contains a drawing assignment. In the present example one team member from each team is asked to make as many drawings of animals as possible within a prescribed time interval. Then the other team members guess which kind of animal their team mate has drawn. The team making most correct guesses wins the competition.

A fourteenth type of question cards 10, e.g. the card in column 2, row 5 of FIG. 10, characterizes a certain phenomenon by a set of features and the team having a turn has to guess the phenomenon. In the present example, a specific year (1990) is characterized by Oscar winning best film, best instructor, best male leading role, and best female leading role.

What is claimed is:

1. A game apparatus for use in a game, the game apparatus comprising:

a quantity of play pieces for keeping a score;

questions cards having questions printed thereon; and a selector that selects one of the question cards for a team, the play pieces being adapted for betting, so that the team having a turn may bet a selected number of play pieces that the team having a turn can answer the question of a selected question card correctly, and teams not having a turn may optionally bet a selected number of play pieces on whether or not the team having a turn can answer the question of a selected question card correctly, so that all teams participate actively in the game during each turn of the game, the play pieces being further adapted to be collected or paid according to a betting result after the team having a turn has answered the question, subsequently starting a next turn, wherein the game ends when one of the teams has won a predetermined number of play pieces and is thus declared winner.

2. A game apparatus according to claim 1, wherein the selector selects a set of questions from a plurality of sets of questions, the question cards having a respective question from the set of questions printed thereon and being distinctly marked accordingly, and wherein the team having a turn activates the selector for selection of a specific set of questions.

3. A game apparatus according to claim 2, wherein the selector comprises at least one dice.

4. A game apparatus according to claim 2, wherein the selector comprises a turn table operable as a wheel of fortune.

5. A game apparatus according to claim 2, wherein the selector comprises a set of selector cards, each of which is distinctly marked to indicate a specific set of questions, to be drawn by one of the teams, a mark of a drawn selector card determining the selected set of questions.

6. A game apparatus according to claim 3, further comprising a game board, wherein the selector comprises multiple contiguous playing spaces positioned on the game board, each of the playing spaces being distinctly marked to indicate a specific set of questions, and a distinct team moving piece for each team, each team moving a corresponding team moving piece forward a number of spaces shown on the at least one dice from a first playing space to a second playing space, a mark of the second playing space determining the selected set of questions.

7. A game apparatus according to claim 1, further comprising a game board.

8. A game apparatus according to claim 7, wherein the game board contains play piece holders for receiving and holding the play pieces.

9. A game apparatus according to claim 7, wherein the game board contains question card holders for holding the question cards.

10. A game apparatus according to claim 1, wherein a question card has a type of question with two possible answers "yes" or "no".

11. A game apparatus according to claim 1, wherein a question card has a set of possible answers to a question printed thereon and the team having a turn answers the question by selecting one of the printed answers on the question card.

12. A game apparatus according to claim 1, wherein a question card specifies a competition, all of the teams of the game becoming competitors in the competition, the teams betting on whether or not the team having a turn wins the competition.

13. A game apparatus according to claim 12, wherein a question card has a plurality of correct answers and the team that writes down a most number of correct answers wins the competition.

14. A game apparatus according to claim 12, wherein a question card specifies a game of dice.

15. A game apparatus according to claim 12, wherein a question card has a word game task to be performed by all of the teams wherein a number of letters are listed on the question card and the teams are asked to create words containing the listed letters.

16. A game apparatus according to claim 1, wherein a question card has a statement to be guessed by the team having a turn.

17. A game apparatus according to claim 1, wherein a question card has a list of words to be guessed by the team having a turn, whereby a team member describes a word to another team member without using the word.

18. A game apparatus according to claim 1, wherein a question card has a number of questions and a same number of answers printed thereon, and a task of the team having a turn is to pair the questions and answers correctly.

19. A game apparatus according to claim 18, further comprising indicators for marking the pairing of questions and answers made by the team having a turn.

20. A game apparatus according to claim 1, wherein a question card has a question and a number of possible answers to the question printed on the question card and wherein a correct answer to the question comprises a plurality of the printed possible answers.

21. A game apparatus according to claim 1, wherein a question card has an extra question printed thereon providing a bonus to the team having a turn if the question is answered correctly.

22. A game apparatus according to claim 12, wherein a question card directs all of the teams to write down words with a specific characteristic.

23. A game apparatus according to claim 12, wherein a question card directs all of the teams to write down words with a specific characteristic and used in a specific context.

24. A game apparatus according to claim 1, wherein a question card contains a drawing assignment.

25. A game apparatus according to claim 1, wherein a question card characterizes a certain phenomenon by a set of features and the team having a turn has to guess the phenomenon.

* * * * *